United States Patent [19]

Fowler et al.

[11] Patent Number: 4,834,667

[45] Date of Patent: May 30, 1989

[54] VIBRATION RESISTANT ELECTRICAL COUPLING

[75] Inventors: Clifford C. Fowler, Chatsworth; Edward P. Goett, Geyserville, both of Calif.

[73] Assignee: Engineered Transitions Co., Inc., Geyserville, Calif.

[21] Appl. No.: 241,322

[22] Filed: Sep. 7, 1988

Related U.S. Application Data

[63] Continuation of Ser. No. 832,403, Feb. 24, 1986, abandoned, and a continuation-in-part of Ser. No. 819,604, Jan. 17, 1986, abandoned.

[51] Int. Cl.[4] ..... H01R 13/623

[52] U.S. Cl. ..... 439/321

[58] Field of Search ..... 439/312-323

*Primary Examiner*—Joseph H. McGlynn

*Attorney, Agent, or Firm*—Shlesinger & Myers

[57] ABSTRACT

A connector accessory for electrical connectors containing a detent or locking member or members for preventing disconnection from an attached connector when the assembly is subjected to vibration, shock or other stresses. The accessory consists of a coupling and a body containing the accessory which in one form is a detent and in another form serves as a detent in one direction of rotation and a permanent or temporary lock in the other direction of rotation. The coupling is provided with screw threads to engage an accessory thread at the rear of an electrical connector and the body contains features which are required to provide proper mechanical and environmental interface characteristics to mate with various electrical connectors, i.e., teeth, splines, seals, etc. When the accessory is mated to an electrical connector, the rotation of the coupling is restricted by a spring and tooth mechanism interfacing between the coupling and the body to prevent the coupling from counter-rotating and allowing the accessory to become loosened or separate from the back of the connector. This concept may also be employed on a connector coupling ring as well.

10 Claims, 2 Drawing Sheets

VIBRATION RESISTANT ELECTRICAL COUPLINGcl BACKGROUND OF THE INVENTION

This is a continuation of application Ser. No. 832,403 filed Feb. 24, 1986 now abandoned and a continuation-in-part of Application Ser. No. 819,604 of Clifford Fowler, filed Jan. 17, 1986, for VIBRATION RESISTANT ELECTRICAL COUPLING.

The present invention relates to an accessory for a multi-wire electrical connector. More particularly, the present invention relates to mechanical spin couplings for backshell adapters for connectors containing multiple electrical connectors and for the coupling between the male and female members of the connector itself.

It is common practice to group a number of electrical conductors together so they may be simultaneously joined by a single two part mechanical coupling. The two halves of the mechanical coupling, upon which complimentary halves of electrical connectors are mounted, are pushed together to form the appropriate electrical connection between the desired connector halves, with the two halves held together by a spin coupling. It is also well known to employ a backshell accessory (a.k.a. backshell adapters) with such connectors. A connector backshell accessory is an electromechanical device designed to adapt or provide a transition from the wire cable bundle to the terminating connector. Such backshell adapters are normally tubular in construction and are attached to the rear of the connector to provide certain additional functions to the connector/cable system which are not usually provided by the connector.

At one end, known as the connector interface, the interface is configured with features needed to properly mate to an electrical connector and provide mechanical, electrical and environmental characteristics needed to meet designed system performance requirements.

The opposite end, usually termed the cable entry end, is designed to accept various components to adapt the incoming conduit, cable, etc. into an integrated interconnect system, to meet overall system performance requirements. Typical components used at this end are "strain-relief clamps," "sealing glands," "conduit fittings," "shield grounding rings," etc. and can be used individually or in combination or even incorporated directly into the body of the accessory.

These devices are attached to the rear of electrical connectors by means of a threaded coupling device which has been designed specifically to interface and attach mechanically with each unique circular connector design. The adapter is usually composed primarily of a body which butts against the back of the connector to a threaded spin coupling secured to the adapter body and which screws onto the back of the connector, thus holding the two together.

Electrical connector backshell accessories are designed to conform to pre-established envelope restrictions required by current military specifications (i.e., MIL-C-85049.) These backshell accessories are also referred to as backshell adapters or "adapters."

This configuration is effective in initially securing an accessory to a connector, and is sufficient to maintain the engagement of the connectors in most situations where the coupling does not undergo shock, vibration, or other stress. However, due to the freedom of rotation of the collar, the coupling can easily disconnect and fail if subjected to shock or vibration, especially over an extended period of time.

In a substantial portion of common applications, these couplings are subjected to a considerable amount of shock over a substantially prolonged period of time. Couplings of this type are often used on mobile or portable equipment, self-propelled machinery, and aircraft and are used extensively in military equipment where rigid securing specifications must be maintained and uncoupling cannot be tolerated. The above problems are also encountered in the coupling between the male and female members of a multiconductor connector. The two halves are normally held together by a threaded spin coupling that is subject to loosening due to shock and vibration.

Previous attempts to limit the rotation of the collar in order to reduce unscrewing and therefore reduce the likelihood of uncoupling have been attempted. U.S. Pat. Nos. 4,239,314 to Anderson and Tomsa, 4,272,144 to Brush, Warth and Schildkraut and 4,291,933 to Kakaris teach previous attempts at controlling uncoupling. In each of those patents a mechanism is located in the collar which engages teeth formed in one half of the body of the coupling. The placement of the mechanism within the collar necessarily enlarges the exterior circumference of the collar, making the resulting overall coupling too large for many applications. These references also do not teach a method for retrofitting a standard coupling to help prevent loosening under vibration. The ability to retrofit standard couplings is an important element since, if such can be accomplished, it permits present fittings to be altered to meet stringent military specifications in this area and also permits units in the field to also be retrofitted thus saving millions of dollars in replacement costs.

U.S. Pat. No. 3,594,700 to Nava also teaches a means to reduce uncoupling problems. In Nava the teeth are formed in the collar and a large ring containing multiple spring members is installed around the body. Nava also does not teach retrofit or maintenance of critical dimensions of the coupling.

The coupling of the present invention is resistant to shock, vibration and stress. Standard couplings can be retrofit by the teachings of the present invention without enlargement of the dimensions of the coupling or degradation of the connector performance.

SUMMARY OF THE INVENTION

The coupling of the present invention utilizes a spring mounted in a groove and alignment hole in of the accessory body; the spring engaging teeth in a securing collar of a spin coupling which rotates around the accessory body whereby the spring-tooth arrangement restrains the rotation of the collar. The securing mechanism of the present invention has the advantage of keeping the overall exterior dimensions to a size as dictated by currently commercial couplers and of being compatible therewith, as well as allowing modification of such couplings not possessing any anti-rotation mechanism.

Keeping the exterior circumference of the collar within the limits presently existing for couplings is important for many applications where the coupling may be required to fit into a limited area, or where the coupling half may have to pass through a small opening such as a hole in a bulkhead. Also, and most importantly, many military applications and specifications require an exterior collar size which cannot exceed critical limits or which conform to current specifications.

The need for a securing system which can be retrofitted to existing couplings also possesses many advantages over the prior art. Another very important feature is that previously manufactured couplings still in inventory need not be discarded and replaced with new supplies. Existing couplings can be modified to lock the collar against uncoupling from shock, vibration, or stress by notching the coupling body half and forming teeth into the retaining collars or replacing the collar in accordance with the teachings of the present invention.

In one embodiment of the present invention the spring has a protrusion extending into the region between the teeth of the spin coupling. The protrusion has sloping surfaces engaging adjacent teeth so that rotation in either direction is detented.

In another embodiment a pellet is inserted between the protrusion and the body of the connector which pellet cannot be compressed at room temperature thus locking the spin coupling in a specific position. Upon heating the pellet becomes resilient and the spin coupling may be rotated and is again detented.

In still another embodiment, the protrusion is terminated between adjacent the teeth with the end of the protrusion engaging the side of a tooth. Thus the spin coupling is detented in one direction and locked in the other direction of rotation.

If the locking spring above is made of a bi-metal or a shape memory metal, the mechanism locks the spin coupling against rotation at room temperature but when heated is withdrawn and permits free rotation of the spin coupling in either direction.

BRIEF DESCRIPTION OF THE DRAWINGS

For a further understanding of the nature and objects of the present invention, reference should be made to the following detailed description, taken in conjunction with the accompanying drawings in which like parts are given like reference numerals and wherein.

DETAILED DESCRIPTION OF THE PREFERRED EXEMPLARY EMBODIMENT

Figure 1:
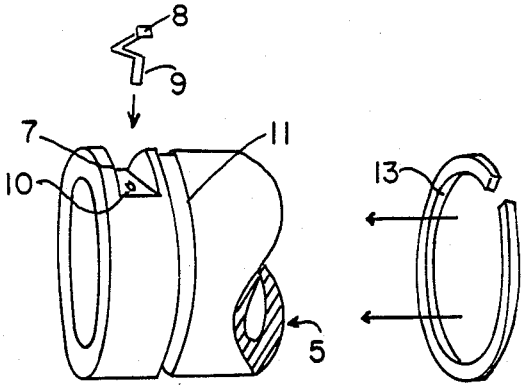
FIG. 1 is an isometric view of the preferred embodiment of the body of the present invention.

As shown in FIG. 1, there is illustrated the body of a standard connector accessory 5. The body is modified with a notch 7 and alignment hole 10. A detent spring 8 is placed in notch 7 with the bottom tab 9 inserted into alignment hole 10. Conventionally, groove 11 encircles the exterior of the body half 5 and seats retaining ring 13. The invention can also be used with threaded couplings to the body as well as crimped or rolled coupling shoulders or clip shoulders.

Figure 2:
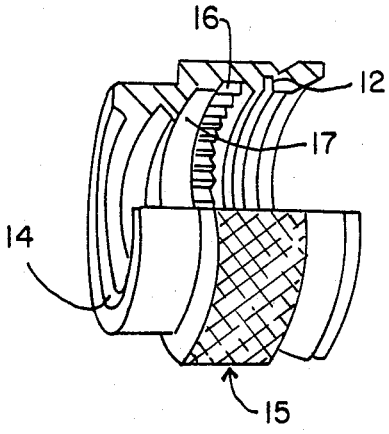
FIG. 2 is a partial cutaway isometric view of the preferred embodiment of the securing coupling of the present invention.

A securing collar 15, as shown in FIG. 2, is modified by the addition of teeth 16 to the interior surface of the collar 17. The collar 15 has a retaining groove 12 complimentary to groove 11. The teeth 16 are located relative to a retaining groove 12 on the body of the backshell body so that the teeth 16 are engaged by spring 8 when the member 15 is fully seated on the body 5.

Figure 3:
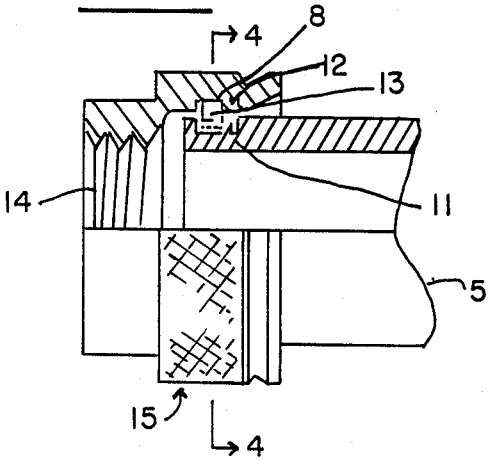
FIG. 3 is a partial cutaway side view of the preferred embodiment of the collar mounted on the body of the present invention.

The collar 15 is positioned on the coupling body 5 and in the example illustrated in FIG. 3 employs retaining grooves 11 and 12 aligned and retaining ring 13 seated in both grooves. Detent spring 8 aligns with and engages the teeth 16 as shown in greater detail in FIG. 4. Retaining ring 13 retains the securing collar 15 on the body 5 while allowing the collar 15 to rotate freely about the body 5. The collar 15 is rotated in the appropriate direction to allow the threaded end 14 of the collar to engage the connector body in order to secure the coupling together.

Figure 4:
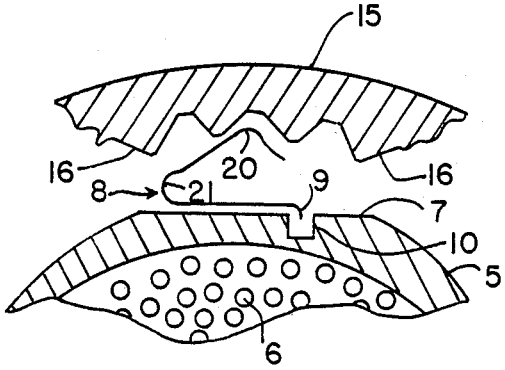
FIG. 4 is a partial sectional view taken along line 4—4 of FIG. 3.

Detent spring 8 aligns with and engages the teeth 16 as illustrated in FIGS. 3 and 4 to prevent the collar 15 from rotating about the body 5. The spring 8 is seated in groove 7 and aligned by tab 9 inserted into alignment hole 10. Upper protrusion 20 is biased into engagement with teeth 16 and therefor offers resistance to the rotation of collar 15 as protrusion 20 must be deflected to allow rotation of the collar 15. The spring may also be held by brazing, welding, solder, adhesives, press fit, etc.

The degree of resistance offered by the spring 18 can be varied in a number of ways. Use of different materials and material composition for the spring will effect its degree of detent. Variation of the degree of curvature at 21 will also effect the resistance offered by the spring 8. Another preferred method of obtaining the desired degree of detent is by variation of the protrusion 20 to adjust the angle and surface with which it abuts the teeth 16. Multiple springs may be employed about the periphery, the thickness of the spring may be varied to control its force, etc.

Figure 4A:
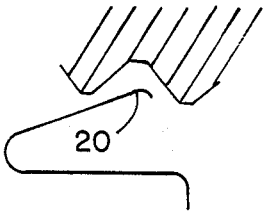
FIGS. 4A–4C are side views of exemplary alternative embodiments of detent springs.
Figure 4B:
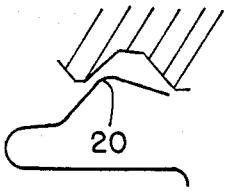
Figure 4C:
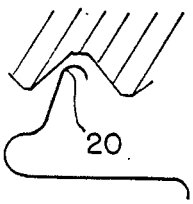

By adjusting the shape of the protrusion 20, the detent spring 8 can be configured to offer greater resistance to rotation in one direction than in the opposite direction. Examples of such non-symmetrical detent springs are illustrated in FIGS. 4A, 4B and 4C. FIG. 4 illustrates a spring that provides an essentially equal resistance in both directions. The shallow slope of the left side of protrusion 20 of FIG. 4A as compared with the sharp slope of the right side requires more force to move the collar counter clockwise than clockwise. The shallow slope of the right side of the protrusion 20 of FIG. 4B as compared with the sharp slope of the left side requires more force to move the collar clockwise than counter clockwise and thus it is easier to tighten the collar than to back it off. This configuration thus strongly resists decoupling in the force of vibrations. It is obvious that by interchanging the left and right slopes, the coupling force can be made greater than the decoupling force or can serve the original intent on left hand threads. FIG. 4C illustrates an arrangement requiring larger forces than those of FIG. 4A and which can be modified to provide the same functions as FIG. 4B.

A standard coupling which does not contain any anti-rotation mechanism can be modified according to the teachings of the present invention so as to be secure from shock and vibration, by a single machinery operation, for instance, to include a groove corresponding to groove 7 and an alignment hole corresponding to hole 10 may readily be drilled into the body. A detent spring would then be seated and aligned in the groove as taught above.

Teeth would then be formed into the inner surface of a standard collar 15 to interact with the detent spring. An alternative would be to remove the standard collar and replace it with a collar 15 already incorporating teeth on its internal surface.

A significant improvement is realized by the ability to modify existing couplings and bodies without the need to replace the components. This eliminates the need to discard existing inventories that do not currently meet various military standards currently being waived because of the inability of the existing couplers to meet the specifications.

Figure 5:
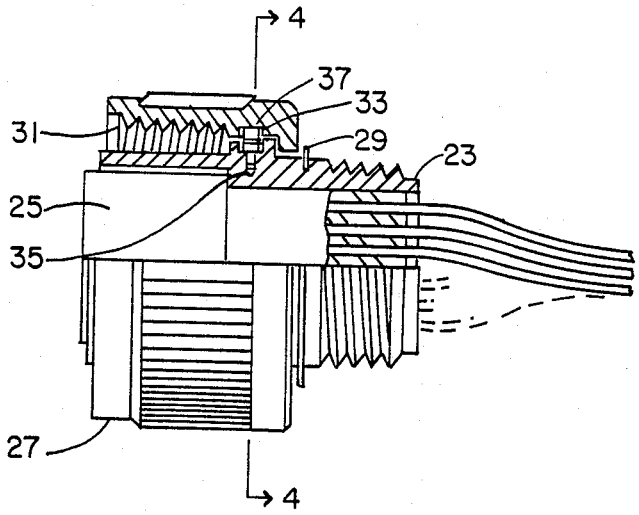
FIG. 5 is a partial cutaway side view of a connector coupling employing the present invention.

Referring specifically to FIG. 5 of the accompanying drawings, there is illustrated a connector body employing the present invention. A body 23 houses the female part 25 of the connector. The body 23 has dispersed about it a spin coupling 27, retained by a retaining ring 29. The coupling 27 is threaded at its left end as viewed in FIG. 5, reference numeral 31 and has serrations on teeth 33 formed circumferentially about its inner surface to the right of threads 31. The body 23 is received at 35 radially inward of the teeth 31 and is drilled to receive the end of a spring 37 which engages the teeth 33, all as illustrated in greater detail in FIG. 1.

Figure 6:
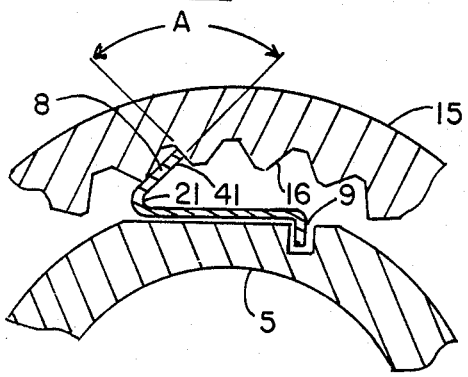
FIG. 6 is a sectional view of one form of a mechanism of the present invention providing detenting in one direction of rotation and permanent locking in the other direction of rotation.

Referring now specifically to FIG. 6 of the accompanying drawings there is illustrated a modification of the present invention which permits permanent locking of the spin coupling to the body 5.

This change from detenting to locking is accomplished by cutting off the protrusion 20 of the spring 8 at the bend that is seated between teeth of FIGS. 4 and 4A–C. Specifically, the spring 8 now includes the tab 9, the curve 21 and a straight member 41. When the outer shell 15 is rotated clockwise the member 41 is depressed by the teeth 16 of the shell and rotation is detented but not prevented. Attempted rotation of the shell 15 counterclockwise, however, is prevented by the engagement of the end of the member 41 with the side of a tooth 16. Thus not only is the member 41 not provided with a return sloping surface but it is angled so as to positively engage a tooth. Counterclockwise rotation can be accomplished only by destroying the spring 8.

Figure 7:
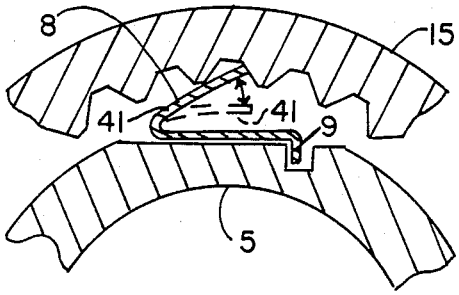
FIG. 7 is a sectional view of another form of one way locking mechanism which lock is released upon heating the element.

Referring now to FIG. 7 of the accompanying drawings, there is illustrated a modification of the locking mechanism of FIG. 6. The configuration of the spring 8 is essentially the same but the material of the spring may be a bi-metal or a shape memory alloy such as Nitinol.

The member 41 is configured such that at room temperature, for instance, it has the shape illustrated by solid lines in FIG. 7. When heated, however, the member 41 assumes the dashed line shape of FIG. 7. Thus by heating the coupling above a specified temperature the member 41 moves away from the teeth 16 of sleeve 15 and the sleeve may be freely rotated counterclockwise. Below such specified temperature the member 41 engages a tooth 16 and counterclockwise rotation is prevented.

The operation of a bi-metal in such a device is the result of different rates of thermal expansion of two metals. Nitinol, as other shape memory metals, has a martensitic state and an austenitic state. The austenitic state has shape memory so that when the metal is heated to sufficiently to assume its austenitic state it reverts to whatever shape has been imparted to it in such state. In the martensitic state the material is flexible. In FIG. 7 the austenitic state is that illustrated by the dashed lines.

Figure 8:
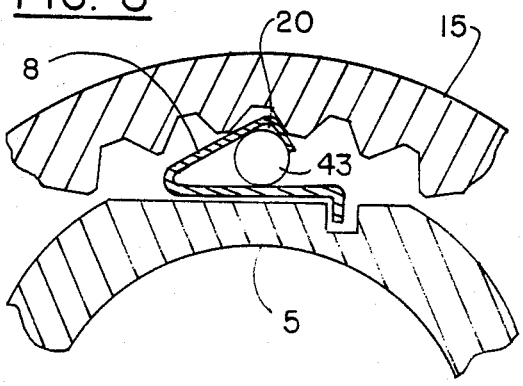
FIG. 8 is a sectional view of a two way locking mechanism which is released by sufficient heating of the device.

Referring now specifically to FIG. 8 of the accompanying drawings, there is illustrated a modification of the device of FIG. 4. The locking feature results from the use of a pellet 43; the spring 8 being basically the same as in FIG. 4. The pellet lies between the protrusion 20 and the base of the spring lying along the flat 10. Below a specific temperature the pellet will not collapse so that the member 15 cannot rotate in either direction.

The pellet is made from a polyolefin having a modulus of elasticity of over 1000 psi at room temperature. When heated above its crystalline melt temperature, the modulus of elasticity drops to below 100 psi. The pellet can now be compressed so that the spin coupling may be rotated in either direction.

The pellet may be irradiated polyvinylidene-flouride, an irradiated neoprene-polyethylene copolymer with prorads or the like.

Because many varying and different embodiments may be made within the inventive concept herein taught, and because many modifications may be made in the embodiments herein detailed in accordance with the descriptive requirements of the law, it is to be understood that the details herein are to be interpreted as illustrative and not in a limiting sense.

I claim:

1. A detent mechanism for a connector backshell adapter, comprising:

a cylindrical body shell, a hollow cylindrical collar rotatably positioned coaxially around said shell, a detent spring member, a detent spring member engaging surface formed in the inner surface of said collar in generally radial alignment with said surface defining said outer diameter of said collar, said detent spring member engaging surface having a plurality of detenting surfaces formed therein, said shell having an outer surface generally radially aligned with the surface defining the inner diameter of said collar, retaining means for retaining said detent spring member formed in said outer surface of said shell and defining a groove located substantially transverse to the direction of elongation of the cylindrical body shell, attachment means for fixedly attaching said detent spring member to said retaining means, said detent spring member seated on and secured to said retaining means by said attachment means, said detent spring member engaging said detenting surfaces whereby to detent movement of said collar relative to said shell.

2. A coupling member according to claim 1 wherein said groove contains a generally radial alignment hole.

3. A coupling member according to claim 1 wherein said arm is a generally straight finger like member disposed between adjacent teeth and having its end located in abutting relationship with an adjacent tooth whereby the member is depressed by a tooth in one direction of rotation of said collar and abuts an adjacent tooth in the other direction of rotation.

4. A coupling member according to claim 1 wherein, said detent spring means includes a main body portion and a radially deflectable arm having a protrusion adjacent one end thereof for bias engagement with said teeth of said engaging surface.

5. A coupling member according to claim 4 wherein, said teeth constitute an annular array of ratchet-type teeth.

6. A coupling member according to claim 4 wherein said protrusion has means for resisting rotation in one direction with more force than in the other direction.

7. A coupling member according to claim 4 wherein said teeth are shaped to require more force to rotate said collar in one direction than in the other direction.

8. A method for modifying existing coupling members, comprising the steps of:

forming a generally flat groove in a cylindrical body of the coupling members perpendicular to a radius and to the longitudinal axis of said cylindrical body, forming a generally radial indexing hole within said groove, positioning a detent spring in said groove with a tab extending into the indexing hole, and providing ratchet-like teeth in an annular array inside the collar of another of the members substantially in line with the detent spring when the collar is in a coupled position.

9. The method of converting a standard available preexisting, non-detented backshell adapter having a cylindrical connector body and a coaxial outer collar adapted to engage a mating connecting member to a detented connector, comprising the steps of:

forming a flat groove transverse to the direction of elongation of the connector body on the connector body underlying the collar, securing to the connector body in the groove of reduced diameter a spring having a radial deflectable spring member, forming a plurality of closely spaced teeth on the interior of the collar in radial alignment with the spring member when the collar engages a mating connector body; the spacing between connector body and the collar and the radial length of the spring producing engagement between the spring member and the grooves between the teeth of the collar.

10. The method of retrofitting a standard commercially available, non-detented elongated connector backshell coupling comprised of a backshell body including a coaxial, rotatable outer collar adapted to engage a correspondingly sized connector body, the method being employed to convert the non-detented coupling to a detented coupling in a manner to maintain the same outer dimensions of the connector backshell coupling, the method comprising the steps of:

forming a flat groove substantially transverse to the direction of the elongation of the coupling on the outer surface of the backshell body and underlying the collar, establishing a first element of a cooperating seating member in the transverse groove, incorporating a radially deflectable spring member and a second element of a cooperating seating member, combining the first and second cooperating seating members to secure the deflectable spring member in the transverse groove, forming a plurality of closely spaced teeth on the interior of the collar in radial alignment with the spring member where the spacing between backshell body and the collar produces biased engagement between the spring member and the grooves between the teeth of the collar.

* * * * *